United States Patent [19]

Haselden et al.

[11] 4,020,642

[45] May 3, 1977

[54] COMPRESSION SYSTEMS AND COMPRESSORS

[75] Inventors: Geoffrey Gordon Haselden, Leeds; Guy Francis Hundy, Gravesend, both of England

[73] Assignee: Hall-Thermotank Products Limited, London, England

[22] Filed: Nov. 25, 1974

[21] Appl. No.: 527,104

[30] Foreign Application Priority Data

Nov. 19, 1973 United Kingdom ..... 53666/73
Mar. 20, 1974 United Kingdom ..... 12441/74

[52] U.S. Cl. ..... 62/84; 62/505; 310/54; 418/201

[51] Int. Cl.[2] ..... F25B 43/02

[58] Field of Search ..... 62/505, 84; 418/201; 310/54, 61; 418/96

[56] References Cited

UNITED STATES PATENTS

| | | | |
|---|---|---|---|
| 2,986,905 | 6/1961 | Kocher et al. | 62/505 X |
| 3,105,633 | 10/1963 | Dellario | 62/505 X |
| 3,155,312 | 11/1964 | Douglas | 62/505 X |
| 3,250,460 | 5/1966 | Cassidy et al. | 62/505 X |
| 3,422,635 | 1/1969 | Trenkowitz | 62/505 X |
| 3,432,089 | 3/1969 | Shibbye | 418/201 X |
| 3,795,117 | 3/1974 | Moody, Jr. | 62/505 X |
| 3,811,291 | 5/1974 | Shibbye | 62/84 |
| 3,885,402 | 5/1975 | Moody, Jr. et al. | 62/505 |

*Primary Examiner*—Ronald C. Capossela
*Attorney, Agent, or Firm*—Dowell & Dowell

[57] ABSTRACT

In a gas compression system employing a positive-displacement rotary compressor, liquid is injected into the compressor which is the liquid phase of the gas or vapour being compressed and the compressor temperatures are maintained at about the saturation temperatures of the gas or vapour. The quantity of liquid injected is sufficient to fill, at least partially, the internal compressor clearance gaps. An electric driving motor is contained with the compressor in another chamber of the same of casing and the motor windings are cooled by being bathed in the wet gas mixture leaving the compressor discharge.

12 Claims, 2 Drawing Figures

COMPRESSION SYSTEMS AND COMPRESSORS

Figure 1:
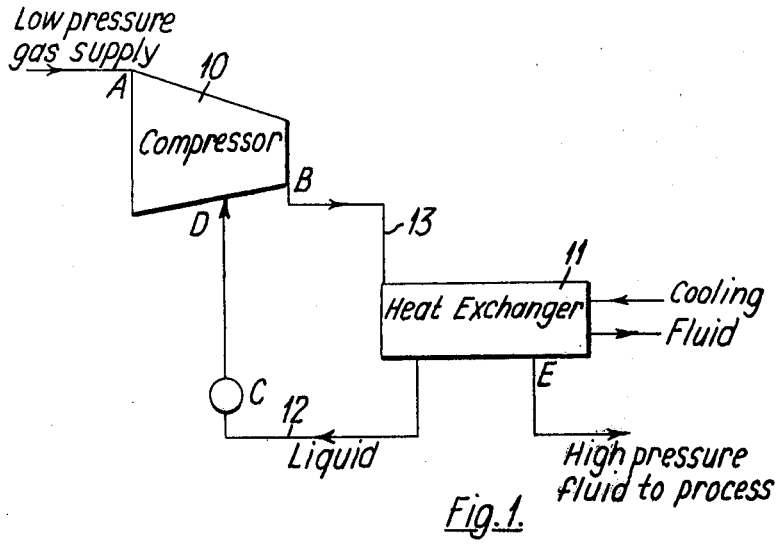

This invention relates to compression systems and compressors, especially refrigeration compressors. The temperature rise of a gas or vapour which occurs during compression is a phenomenon which must always be considered when designing compressors. Jackets through which cooling water is circulated are commonly used to reduce temperatures and raise the compression ratio a machine can usefully attain. With a rotary positive displacement compressor whose speeds are relatively high it becomes difficult to design jackets which can carry away heat at sufficient rates. Examples of such compressors are screw compressors.

The high temperatures attained mean that such compressors need to have large running clearances because of the differential thermal expansion of the components. The resulting leakage losses can be reduced by increasing the compressor speeds; however, the maximum operating speed is limited because aerodynamic losses become significant at very high speeds. Also speed increasing gearboxes make installations more costly, and noise levels are high.

A solution to these problems is to inject a liquid into the compression chambers of the machine which, being comparatively cool, and having a large heat capacity per unit volume compared to the compressed gas or vapour, readily absorbs much of the heat of compression. The liquid can be separated from the compressed gas or vapour after it has left the compressor. The most common liquids employed for this purpose are oil or water. The compressor runs cooler with such a liquid injected in sufficient quantities and this allows smaller clearances to be used. Also the liquid tends to seal the clearances. The resulting reduction in leakage losses means the compressor can run at lower speeds with good efficiency allowing direct coupling to a synchronous electric motor.

However, as already mentioned the introduction of a second fluid creates the need for separating devices in the delivery line. Where contamination of the compressed medium must be kept to very low levels such devices can become elaborate and costly. Where the cooling fluid is oil, or other fluid which must be recycled, a separate cooler for this fluid is also often required. An example of such a system is a refrigeration system where oil is used as the cooling fluid for a screw type compressor. A separator will recover almost 100% of the oil, but provision must still be made for recovery of oil from remote parts of the system because of the gradual, if very slow, accumulation which can take place. Also problems can arise where sudden thermodynamic changes occur in the systems, such as at start up, because of the pressure variation of refrigerant solubility in the oil. Frothing can occur as pressure is reduced and cause rapid loss of oil to remote parts of the system.

An object of this invention is to eliminate these drawbacks and at the same time to maintain efficient compression at moderate operating speeds. According to the present invention, instead of using a second medium as a coolant and/or sealant, only the gas or vapour which is being compressed is utilized in its liquid phase for this purpose, the temperatures of the machine being maintained close to the saturation temperatures of the gas or vapour being compressed.

The liquid phase of the gas or vapour being compressed is from now on referred to as 'liquid'. Where the pressures in the compressor are below the critical pressure for the gas or vapour concerned, the liquid injected into the compressor will first tend to cool the gas or vapour therein by evaporating. This will continue until saturation conditions are reached after which further liquid will be stable in the compression chamber and will be available for sealing the clearances.

The liquid injection rate can be high because liquid carry-over is permissible in a system with no oil; but strictly not permissible with oil injection. This means the superheat can be brought down substantially to zero with consequent lower temperatures and power saving. Adequate liquid can therefore be used to seal clearance gaps, especially the gaps between one compression chamber and the next. Also, the liquid provides cooling and lubrication of the rotor/gate contact.

Liquid will migrate towards the low pressure side and provide cooling throughout the whole compression process, whereas in previous proposals to introduce a foreign liquid insufficient liquid can be introduced to allow such migration.

The use of refrigerant liquid injection for cooling and sealing has a particular advantage in those configurations of compressor which have low bearing loads so that oil-free bearings can be designed. Such bearings can again use refrigerant liquid for cooling and load carrying and thus eliminate the need for bearing oil supply, with consequent saving of ancillaries.

When, in such a machine, the bearings operate in the absence of oil, a difficulty arises in making an effective gland seal for the power input shaft if oil is to be completely eliminated from the compressor. For this reason, it is advantageous to employ an arrangement where the windings of the driving motor are enclosed in the same housing as the compressor (or an extension of that housing), and reside in the atmosphere of the compressed medium so that the need for a gland seal at entry of the shaft into the compressor casing is eliminated. The rotating members of the compressor and motor can then be combined into one rotor.

Previous designs of oil-lubricated compressor employing this arrangement have utilised the low pressure gas for cooling the motor windings, the compressed discharge gas often being at too high a temperature for this purpose. However, the heat transfer rate tends to become increasingly poor at lower pressures due to the decreasing gas density and this can result in higher winding temperatures at low pressures even with lower gas temperatures.

Another prior design, which has an oil-injected compressor, does utilise the discharge gas for cooling the motor windings. This is made possible by the lower discharge temperatures resulting from the injection of cool oil, and and also the enchanced heat transfer rate due to the presence of the oil. The system has the advantage that the heat from the motor windings does not affect the mass flow rate of gas through the compressor, as happens when cooling is by means of the low pressure inlet gas.

According to a preferred feature of the present invention, the motor windings are cooled with the acid of the compressed medium in the liquid phase, the compressor and motor being contained within the same housing.

The rate of heat tranfer from the motor windings is greater when the windings are cooled by liquid than when cooled by gas, especially if the liquid is evaporating. When the cooling is carried out by liquid at low pressure, the windings can be maintained at low temperature by evaporation of the liquid, the heat transfer rate remaining high because the density of the liquid varies little with pressure.

If the cooling is carried out by liquid at discharge pressure, this liquid can be the surplus from the supply which is injected for sealing and cooling the compressor and which is entrained in the discharge gas. In this case the liquid will be at saturation temperature and the cooling effect will be due to evaporation of this liquid.

An alternative arrangement is to immerse the windings completely in liquid at discharge pressure. The liquid may be saturated or subcooled and can be circulated by means of a small pump or impeller on the motor shaft.

In designs of compressor where the high pressure fluid surrounding the motor introduces a thrust load, the bearing between the compressor and the motor can advantageously form the partition between the high pressure and low pressure regions of the casing and thus eliminate the need for a separate seal between these regions. The thrust load is then reduced to the thrust generated by the pressure difference acting on the journal diameter.

It is possible to utilise for cooling the motor windings liquid at any pressure intermediate between compressor suction and delivery by designing the machine so that it can run with the motor windings subjected to the required pressure. This may be advantageous where use of delivery pressure liquid results in too high a winding temperature. Use of a lower pressure will reduce the corresponding saturation temperature for the liquid and hence maintain a lower winding temperature. The gas formed by evaporation of the cooling liquid can be fed into the compressor at an intermediate stage and this can be more efficient than using low pressure liquid where the gas formed reduces the effective compressor capacity.

In a situation where the motor windings could be damaged by contact with the liquid, a design can be used where the windings are encapsulated or where there are passageways which allow the liquid to remove heat without coming into direct contact with the windings.

Figure 2:
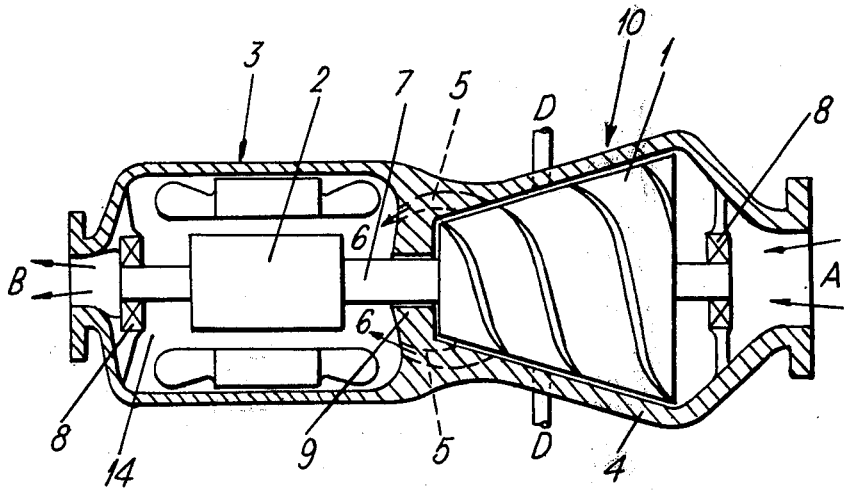

Arrangements according to the invention will now be described by way of example with reference to the accompanying drawings, in which:

FIG. 1 is a schematic diagram of a compression system according to the invention; and FIG. 2 shows the compressor itself in longitudinal section.

Referring firstly to FIG. 1, low pressure gas or vapour enters a compressor 10 at A and the compressed gas or vapour leaves at B. Part or all of this vapour is condensed in a heat exchanger 11 and the liquid formed is injected into the compressor at D by means of a pump C.

A rotary positive displacement compressor acts by trapping a pocket of low pressure gas in a compression chamber and reducing its volume by a certain percentage until an outlet port is uncovered. The pocket is eventually reduced to zero volume so that all the gas is forced into the delivery line. The pressure in the pocket when the delivery port is uncovered is at, or near, the pressure in the high pressure side of the system.

It is convenient to utilise liquid at delivery pressure for injection as shown; but liquid at an intermediate pressure can be used if a source at this pressure is available. It is desirable to minimise the pressure drop of the liquid as it is injected because such a pressure drop is irreversible and results in extra vapour being formed in the compression chamber calling for additional power to recompress this vapour to delivery pressure. For this reason the injection point or points D are best situated so that injection takes place into chambers which are at or near delivery pressure. In some compressors any one injection point will communicate with a single compression chamber over a considerable range of compression. In such a case it could be advantageous to arrange for the pump C to be of intermittent operation and synchronised with the rate of compressor rotor rotation so that a pulse of liquid is injected into the compressor when the pressure in the chamber into which it is introduced is near its maximum.

When sufficient liquid is entering the compressor 10 and the rotor clearances are at least partially filled with liquid, migration of liquid towards compressor chambers at lower pressures will tend to take place by virtue of the pressure drop across said clearances.

The injection point D can be a single hole, or a multiplicity of holes may be arranged so as to distribute the liquid optionally into the various clearances. A certain amount of subcooling may be desirable for this liquid entering at D. The liquid can be taken from the high pressure region of a refrigeration circuit incorporating the compressor which, if the region from which the liquid is taken is located at a higher elevation than the compressor, may eliminate the need for the pump C. Also it will be appropriate in some cases to insert a valve in the liquid pipeline 12 with the provision for automatic opening of the valve in phase with the frequency of the discharge pulses in the compresser discharge line 13.

Those clearances which link the compression chamber to the suction gallery of the machine, i.e., those through which leakage of fluid causes a volumetric oss, are very important. The pressure difference across such clearances is invariably greater than that across clearances between one compression chamber and the next. Leaking fluid therefore flows through a large irreversible pressure drop in addition to causing loss of volumetric efficieny. When liquid is present in these clearances instead of vapour it will tend to flow into the pressure region by virtue of the pressure difference, in the same way as the vapour. Reduction of the pressure of the liquid will result in a certain percentage evaporating or "flashing". The flash gas thus formed will constitute a volumetric loss. Thus it is still important to maintain such clearances as small as possible when using injection of liquid. It is a feature of this invention that the temperatures in the machine 10 will be low, namely close to the saturation temperatures of the gas or vapour being compressed, thus allowing the critical tolerances to be kept as small as possible.

Whether or not the losses are smaller with the clearances liquid-filled depends on a number of factors, such as compression ratio, viscosity of the liquid and the shape of the saturated vapour curve for the fluid concerned. It must be remembered, however that for a machine without liquid injection the clearances would need to be greater because of the higher temperatures reached. Experiments with a Lysholm type screw compressor have shown an improvement in Volumetric efficiency of 5% as the liquid injection rate was increased from a low level, just sufficient to provide cooling by evaporation, to a higher rate, sufficient to allow penetration of liquid into the clearances. This result was obtained at a compressor pressure ratio of 2:3 to 1 with refrigerant R12 as the working fluid.

When comparing the performance of a machine according to the invention with a similar machine operating with oil injection the volumetric efficiency of the oil-injected machine is difficult to match because of the high viscosity of oil compared to the refrigerant liquid. However, in terms of power Per unit mass of gas compressed, figures very close to those for an oil-injected compressor have been attained with a refrigerant liquid injected machine over the range of compression ratios 2 to 1 to 4 to 1 and it is anticipated that improvement in design of the refrigerant liquid injected machine can further improve performance. Such improved performance can be ascribed to the more efficient compression process which occurs when temperatures are lower.

Referring now to FIG. 2, this shows a compressor suitable for the system of FIG. 1. The compressor 10 and its driving motor 3 are housed end-to-end in a common casing 4. Shafting 7 carries the compressor rotor 1 (gate rotor not shown) and the motor rotor 2 between end bearings 8 of the oil-free type; between the compressor and motor rotors the shafting passes through a partition 9 separating the compressor and motor compartments of the housing. The low pressure vapour inlet A and the delivery outlet B are at opposite ends of the casing 4 and the motor chamber 14, which is at the high pressure end of the compressor rotor, constitutes a discharge chamber for the compressor, the compressed vapour being delivered into the motor chamber 14 from the high pressure end of the compressor chamber through passages 5 in the partition 9.

Since the liquid phase of the vapour being compressed is injected into the compressor chamber at D, the discharge into the motor chamber 14 at 6 consists of a mixture of saturated vapour and liquid. The motor windings bathed in this discharge mixture are thus cooled by evaporation of liquid before the compressor delivery passes through the final delivery outlet B beyond the motor.

There is thus disclosed a compressor and system of compression in which efficient wet compression is achieved and the machine is kept at relatively low temperatures. Prior art oil-injected compressors work at temperatures well above the saturation temperatures of the gas being compressed with the attendant disadvantages.

We claim:

1. A method for the oil-free compression of a gas or vapour using a compression machine of the type having at last one rotary positive-displacement stage and having a casing with a low-pressure inlet and a high pressure outlet and having a compressor rotor in said casing, comprising the steps of introducing the gas or vapour into the inlet, compressing the gas or vapour in the machine, and lubricating the compression machine by injecting thereinto at at least one point intermediate said inlet and said outlet a lubricating fluid consisting entirely of the liquid phase of the gas or vapour being compressed, the quantity of said liquid phase injected being sufficient to substantially fill the clearance gaps between the rotor and the casing and being sufficient to maintain the temperature of the compression machine close to the saturation temperature of the gas or vapour being compressed.

2. A method according to claim 1, wherein the compression machine is a screw compressor and the lubricating fluid is injected into the machine between the ends of the screw.

3. A method according to claim 1, including the steps of taking the compressed gas or vapour from the outlet of the machine, at least partly condensing the compressd gas or vapour to obtain the liquid phase, and injecting some of said liquid phase into the machine as said lubricating fluid.

4. A method according to claim 3, including the step of pumping said liquid phase to raise its pressure before injecting it into said machine.

5. A method according to claim 3, wherein the liquid phase is sub-cooled before injection into said machine.

6. A method according to claim 3, wherein the compression machine has a casing communicating with said inlet and said outlet and has a compressor rotor in said casing, and said liquid phase being injected through said casing at at least one point intermediate the ends of the rotor.

7. A method according to claim 1, wherein the injection of the liquid phase into said at least one point is intermittent and synchronized with the rate of rotation of the compression machine.

8. A method according to claim 1, wherein the compression machine includes a rotor supported on oil-free bearings, and wherein said bearings are lubricated entirely by said liquid phase of the gas or vapour being compressed.

9. A method according to claim 1, wherein the compression machine has a housing containing said rotary positive-displacement stage and wherein said compression machine is driven by an electric motor having windings contained within said same housing, the step of channeling said gas or vapour or its liquid phase over the windings of the motor to cool them.

10. A method according to claim 9, wherein the windings of the motor are immersed in the liquid phase of the gas or vapour being compressed at the discharge pressure thereof.

11. A method according to claim 9, wherein the windings of the motor are located in a chamber communicating with said outlet of the machine and through which the compressed gas or vapour or liquid phase thereof flows.

12. A method according to claim 9, wherein the compressor and the motor are disposed end-to-end in said casing and carried on shafting passing through a partition in said casing separating the low-pressure inlet and the compression stage from the high-pressure outlet and the motor chamber, the step of passing the compressed gas or vapour from the compression stage through the motor chamber to the high-pressure outlet.

* * * * *